United States Patent [19]

Sando et al.

[11] Patent Number: 4,529,128

[45] Date of Patent: Jul. 16, 1985

[54] HIGH TEMPERATURE HOT LIQUID JET NOZZLE

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 514,144

[22] Filed: Jul. 14, 1983

[30] Foreign Application Priority Data

Jul. 16, 1982 [JP] Japan ..... 57-123816

[51] Int. Cl.[3] ..... B05B 1/24; D06B 3/12; D06B 23/18

[52] U.S. Cl. ..... 239/138; 68/5 E

[58] Field of Search ..... 239/137, 138, 135; 68/205 R, 5 D, 5 E; 15/302

[56] References Cited

U.S. PATENT DOCUMENTS 1,961,971 6/1934 Ignace ..... 239/137

4,416,123 11/1983 Sando et al. ..... 68/5 E

*Primary Examiner*—Andres Kashnikow

*Assistant Examiner*—Scott D. Malpede

*Attorney, Agent, or Firm*—Wenderoth, Lind & Ponack

[57] ABSTRACT

A high temperature hot liquid jet nozzle comprising a cylindrical liquid supply tube having a slit along its generating line and a steam jet pipe provided coaxially within the liquid supply tube forming a narrow gap therebetween to serve as a liquid passage and having a steam jet opening positioned in the slit. By supplying high temperature and pressure steam into the steam jet pipe, a treating liquid in the liquid supply tube is heated nearly to the temperature of the steam and thus heated treating liquid in the liquid supply tube is blown through the slit of the liquid supply tube together with steam jetted through the steam jet opening of the steam jet pipe to a cloth to be treated.

4 Claims, 2 Drawing Figures

HIGH TEMPERATURE HOT LIQUID JET NOZZLE

BACKGROUND OF THE INVENTION

The present invention relates to a high temperature hot liquid jet nozzle for continuously applying a hot liquid at a temperature above 100° C. to a cloth to be wet-heat treated.

For subjecting a long cloth to such treatments as scouring, bleaching, dyeing, resin finishing and weight reducing continuously, such means as an ordinary pressure treating method which is carried out at an ordinary atmospheric pressure and a high pressure treating method which is done at an elevated pressure higher than an ordinary atmospheric pressure have usually been adopted. However, the former ordinary atmospheric pressure treating method requires a long time at a temperature below 100° C. until the treatment is completed, thus lacking high productivity, and furthermore, the quality of the product is not satisfactory. Therefore, the latter high pressure method, in which the treatment can be done speedily at a high temperature and the quality of the product is excellent, is widely adopted at the present time.

This high pressure treating method allows continuous wet-heat treatment of a cloth under high temperature and high humidity by using a steamer can or reactor which can hold high temperature and high humidity, while permitting continuous feeding of the cloth therethrough. By effecting wet-heat treatment under high temperature and high humidity, a treating agent is caused to react with the cloth whereby a desired processing, such as scouring, bleaching, dyeing, resin finishing, weight reducing or the like, can be effected continuously at high speed. In such wet-heat treatment under high temperature and high humidity, however, it is necessary to hold the atmosphere within the steamer can at high temperature and at high humidity, preparatory to starting the wet-heat treatment, and consequently it requires a relatively long time until the atmosphere within the steamer can attains a predetermined high level of temperature and humidity. Accordingly, this treatment requires relatively long readiness time before actually starting the cloth treating operation and, furthermore, it requires a large amount of thermal energy to attain the predetermined high temperature and high humidity of the atmosphere within the steamer can.

Further, in the case where a pair of seal mechanisms are provided at the cloth inlet and outlet of the steamer can for maintaining the interior of the steamer can at a high temperature and humidity atmosphere while allowing the taking in and out of a cloth continuously therethrough, the construction of the whole apparatus becomes complicated and particularly the construction cost becomes unavoidably very high in a large size apparatus.

SUMMARY OF THE INVENTION

Under such circumstances, the main object of the present invention is to offer a high temperature hot liquid jet nozzle for jetting a high temperature liquid directly and continuously to a cloth to be treated with the aid of the jetting force from the nozzle for speeding up the wet-heat treatment of a cloth, simplifying the construction of the steamer can, preventing heat energy loss, and thus performing wet-heat treatment of a cloth quite economically.

The present inventive high temperature hot liquid jet nozzle comprises a cylindrical liquid supply tube having a slit along its generating line and a steam jet pipe provided coaxially with the liquid supply tube at its inner circumference forming an axially and circumferentially uniform annular narrow gap therebetween to serve as a liquid passage, and having a steam jet opening positioned in the slit. By supplying high temperature and pressure steam into the steam jet pipe, a treating liquid in the liquid supply tube is heated and thus heated nearly to the temperature of the steam, treating liquid in the liquid supply tube is blown in a mist from the slit of the liquid supply tube together with steam jetted from the steam jet opening of the steam jet pipe to a cloth to be treated, and thus the wet-heat treatment of a cloth can be eminently done continuously.

BRIEF DESCRIPTION OF THE DRAWINGS

The drawings are to show an example of the present inventive high temperature hot liquid jet nozzle.

DETAILED DESCRIPTION OF THE PREFERRED EMBODIMENTS

Figure 1:
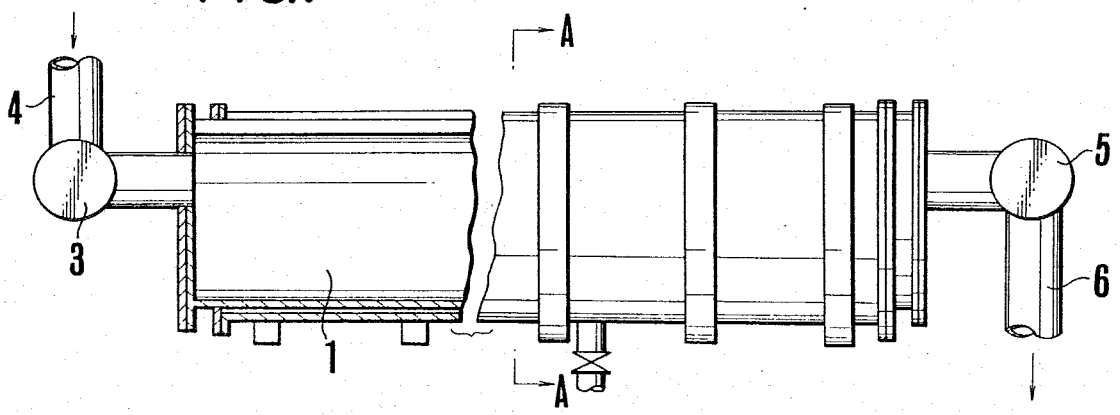
FIG. 1 is a partially sectional side view of the nozzle.
Figure 2:
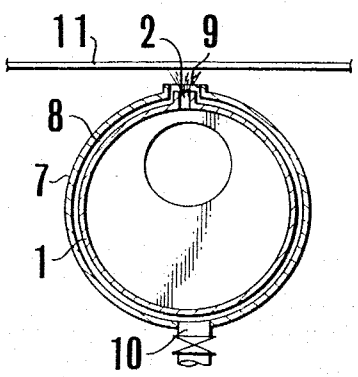
FIG. 2 is a sectional view at line A—A in FIG. 1.

Preferred embodiments of the present inventive high temperature hot liquid jet nozzle will be described in detail in the following by referring to the drawings showing an example of the inventive apparatus.

In the drawings, a steam jet pipe 1 made of pressure- and heat-resistant properties has a steam jet opening 2 comprising a jet slit provided along its generating line. The jet slit may be replaced by a plurality of jet holes. A pressured steam supply pipe 4 is connected to one end of the steam jet pipe 1 by putting a valve 3 therebetween, and a condensed liquid discharge pipe 6 is connected to the other end of the steam jet pipe 1 by putting another valve 5 therebetween.

A cylindrical liquid supply tube 7 is provided with said steam jet pipe 1 coaxially at its inner circumference forming an axially and circumferentially uniform annular narrow gap 8 therebetween and both ends thereof being sealed. (By "narrow" is meant that the width of the gap is very small compared to the radial dimensions of the pipe 1.) A slit 9 is provided along the generating line of the liquid supply tube 7 at the position corresponding to the steam jet opening 2 of the steam jet pipe 1. Reference numeral 10 designates a liquid supply pipe and reference numeral 11 designates a cloth to be treated.

The construction of an example of the present inventive high temperature hot liquid jet nozzle is as mentioned above. Now, its function will be described in the following.

At first, the valve 3 is opened for supplying high temperature and pressure steam at 3 kg/cm$^2$ and about 140° C., for instance, which is supplied from the pressured steam supply pipe 4 into the steam jet pipe 1, and thus the pressured steam is blown through the steam jet opening 2 to the cloth 11. In supplying a treating liquid (for instance, a caustic alkali solution for pretreatment and a dye solution for dyeing) from the liquid supply pipe 10 into the liquid supply tube 7, the treating liquid in the liquid supply tube 7 is heated promptly up to about 140° C. (well above the boiling point of water at atmospheric pressure) due to the effect of high temperature steam in the steam jet pipe 1, and thus heated treating liquid is blown in a mist from the slit 9 of the liquid supply tube 7 together with the pressured steam from the steam jet opening 2 onto the cloth 11 due to the jetting force of steam jetted from the steam jet opening 2.

In jetting the heated treating liquid and steam at a temperature about 140° C. through the slit 9 and the steam jet opening 2 onto a cloth under the ordinary atmospheric pressure, the temperature of the heated treating solution and steam is unavoidably lowered, but it is possible to apply a heated treating liquid and steam to the cloth at a temperature above 100° C. by making the position of the cloth 11 possibly close to the slit 9 and the steam jet opening 2, and thus the wet-heat treatment of a cloth can effectively be done at a temperature above 100° C. under the ordinary atmospheric pressure.

The function of the present inventive high temperature hot liquid supply nozzle is as described above. In the present invention, by jetting a prescribed treating liquid from the slit 9 and simultaneously high temperature and pressure steam from the steam jet opening, a high temperature jetting medium comprising a mixture of a treating solution and steam uniformly and sufficiently mixed is blown onto a cloth to be treated at a temperature above 100° C. for performing the treatment of a cloth with a treating solution effectively at the ordinary atmospheric pressure.

The amounts of the treating liquid and moisture to be applied to the cloth can freely be controlled by controlling their amounts jetted from the nozzles, so that there is no loss nor shortage of the treating solution for producing economically a product of excellent quality. Further, by using the present inventive nozzle a definite amount of treating liquid can be applied to the cloth without using squeeze rollers, and therefore, a cloth can be treated uniformly all over the cloth.

What we claim:

1. A high temperature hot liquid jet nozzle for treating a cloth, comprising a liquid supply tube having a slit along its generating line, and a steam jet pipe provided coaxially within the liquid supply tube forming an axially and circumferentially uniform narrow gap therebetween to serve as a liquid passage and having a steam jet opening positioned in the slit, said steam jet pipe comprising means for heating a treating liquid in said liquid passage with high temperature and high pressure steam in said steam jet pipe to a temperature near to that of the steam, said slit and steam jet opening comprising means for releasing a mist of the treating liquid with the steam, from said slit and opening, whereby a treating liquid in said liquid supply tube is heated by high temperature and pressure steam supplied into said steam jet pipe and the treating liquid thus heated in said liquid supply tube nearly to the temperature of the steam is blown in a mist together with the steam jetted from said steam jet opening of said steam jet pipe to a cloth to be treated.

2. A nozzle as in claim 1, wherein said liquid supply tube and said steam jet pipe are cylindrically shaped.

3. A nozzle as in claim 1, wherein said heating means comprises means for heating said treating liquid to about 140° C., said releasing means comprising means for releasing the mist at a temperature of about 140° C.

4. A nozzle as in claim 1, wherein said gap has a width very small in comparison to the radial dimensions of said steam jet pipe.

* * * * *